US005181869A

United States Patent [19]

Dantono et al.

[11] Patent Number: 5,181,869

[45] Date of Patent: Jan. 26, 1993

[54] TILLER HANDLE EXTENSION

[76] Inventors: David F. Dantono, 24 Laurel Dr., Bridgewater, Mass. 02324; Darrell F. LaTremouille, 72 Keith Pl., E. Bridgewater, Mass. 02333

[21] Appl. No.: 848,272

[22] Filed: Mar. 9, 1992

[51] Int. Cl.[5] ..... B63H 21/21

[52] U.S. Cl. ..... 440/53; 74/544; 114/144 R; 440/63

[58] Field of Search ..... 440/63, 84, 87, 53; 114/144 R, 162, 146; 74/480 B, 544

[56] References Cited

U.S. PATENT DOCUMENTS

| | | | |
|---|---|---|---|
| 2,826,931 | 3/1958 | Michler | 74/480 B |
| 3,929,086 | 12/1975 | Alter | 114/144 R |
| 3,955,438 | 5/1976 | Zakrzewski | 440/87 X |
| 4,650,429 | 3/1987 | Boda | 74/480 B |
| 5,046,974 | 9/1991 | Griffin, Jr. et al. | 440/63 |

*Primary Examiner*—Sherman Basinger
*Attorney, Agent, or Firm*—Francis J. Clark

[57] ABSTRACT

A tiller handle extension for use as a furtherance of a marine type outboard motor tiller control handle by attaching it to a tiller control handle by using an adapter that is modified to fit a tiller control handle. The device is adapted to be used quickly and easily by use of any adapter modified for attaching to virtually all sizes of tiller handles. The device not only permits one to control the throttle on the tiller control handle, but is an extension of the kill button, which stops the motor. The kill button is usually located at the outer end of the motor's tiller control handle. By attaching the present invention to the tiller control handle, the kill button is extended, by use of an actuator within the present invention, to the end of the tiller handle extension. This permits an operator to stop the motor by pushing a button, which is part of an actuator located in the present invention, which in turn depresses the actual kill button on the end of the tiller control handle. The tiller handle extension also does not restrict access to a kill switch and lanyard, which are located closer to the motor. This combination is used as an additional safety measure in case an operator falls overboard.

1 Claim, 2 Drawing Sheets

TILLER HANDLE EXTENSION

FIELD OF INVENTION

The present invention relates to a tiller handle extension for extending a kill button located on one end of a short tiller control handle to the furthest end of the invention, permitting an operator to continue to have the ability to stop the motor. In addition, access to the kill switch also provided on marine-type outboard motors remains readily accessible.

DESCRIPTION OF PRIOR ART

In the sport of boating, the marine-type outboard motor used is equipped with a short tiller control handle. The short tiller control handle prevents an operator from being seated in a somewhat more forward position in the boat so he may achieve better balance of the boat. An operator when positioned in such a manner places himself out of the reach of the tiller control handle and the kill button contained therein.

There have been a variety of extension handles proposed to permit an operator to be seated forward in a boat. Almost invariably some of the prior art devices have used sleeves to encircle the tiller control handle so as to cover up the kill button and kill switch thereby defeating the purpose of stopping the motor when needed. A disadvantage to the above prior art is that the sleeve covers up the kill button, thus, causing the operator to have to remove, by disassembling, the extension handle to push the kill button so the motor may be shut off. Another disadvantage is that the kill switch and lanyard, usually located more toward the motor, is interfered with. This presents a dangerous situation because the aforementioned combination is used as a safety in case an operator falls over board. The lanyard is usually tied to an operator and if he falls overboard the lanyard will engage the kill switch and stop the motor. Covering of the kill switch will prevent this safety system from being actuated. Other prior art, such as that described in U.S. Pat. No. 5,040,432 of Paul A. Carlstedt, issued on Aug. 20, 1991, describes an extension handle being attached to a tiller control handle at one side or off center to the tiller control handle. Although the kill button is available for use by an operator, it is still located at the end of the tiller handle. This is a disadvantage because it is impractical if not impossible for an operator to use. The operator, in order to activate the kill button, must either reach back with one hand while trying to control the tiller with the other hand or move his position to reach the kill button, both being inherently dangerous practices.

Another disadvantage of this prior art is that the offcentered extension handle, although providing the operator to sit more forward in the boat, also puts the operator out of reach of the kill button in case of an emergency. And due to the method of attachment of the extension handle to the tiller, the operator when working the extension handle pulls the extension at an angle which means the tiller control handle is moved at an angle. Handling the extension in this manner exerts stress on the tiller control handle and the extension handle. Stress exerted on the tiller control handle will cause interference with the operation of the tiller control handle, and also cause the extension handle to weaken just above where it is secured to the tiller.

The present invention will overcome all of the aforementioned disadvantages by providing an operator with a simplified way to be positioned where the operator wants to be in the boat, while permitting an operator to keep control of the boat without sacrificing safety.

SUMMARY OF THE INVENTION

The present invention is a greatly improved tiller handle extension for use as an extension of a marine type outboard motor tiller control handle. By using an adapter, modified for use with any type of tiller control handle, the present invention is suitable for use quickly and easily by attaching to virtually all sizes of tiller handles. The present invention permits an operator to stop the motor by attaching, by using an adapter, the device to a tiller control handle. By so attaching, the kill button on a tiller control handle is physically extended to the end of the tiller handle extension. This permits an operator to push the kill button at the end of present invention to stop the motor. Furthermore, the present invention permits an operator to continue to have control over the throttle on the tiller handle. This is accomplished by securing an adapter to the tiller control handle and inserting and securing the present invention to the adapter. By attaching and securing these components together, the present invention, when moved in a circular motion will move the throttle. The present invention tiller handle extension also does not restrict access to the kill switch and lanyard, which are used as a safety in case an operator falls overboard.

The main object of the present invention is to provide a tiller handle extension for a tiller control handle of an outboard motor to give the operator total and complete access to the kill button of the tiller control handle by permitting an operator to use the actuator located within the tiller handle extension to stop the motor.

Another object of this invention is to provide an operator full control of the throttle of an outboard motor with the use of the present invention.

Other objects of this invention will become more apparent from the description which follows.

DETAILED DESCRIPTION

Figure 1:
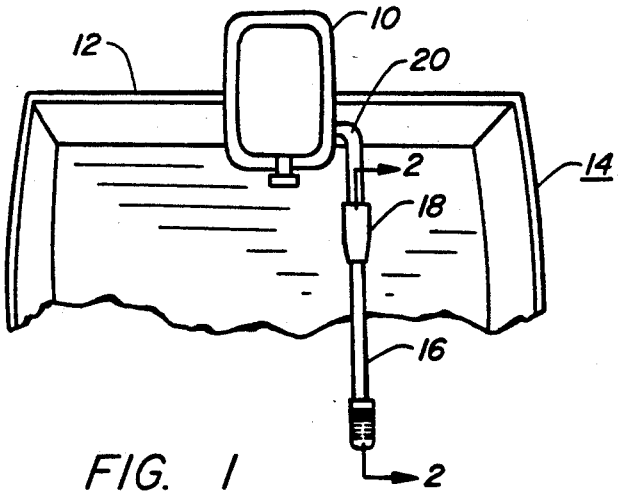
FIG. 1 is a top plan view of the present invention centrally attached to a tiller control handle of a marine type outboard motor.

With reference to FIG. 1 an outboard motor 10 is mounted on the stern 12 of a boat 14. The present invention tiller handle extension 16 is shown attached to an adapter 18, with the adapter 18 and the present invention 16 being centrally mounted onto the tiller control handle 20 so as to be positioned on the center line of the tiller control handle 20. The present invention is not intended to be limited to use in combination with only one type of adapter. The invention is constructed so it may be used with any adapter that is modified to fit a particular tiller control handle of whichever outboard motor a boatman is to use.

Figure 2:
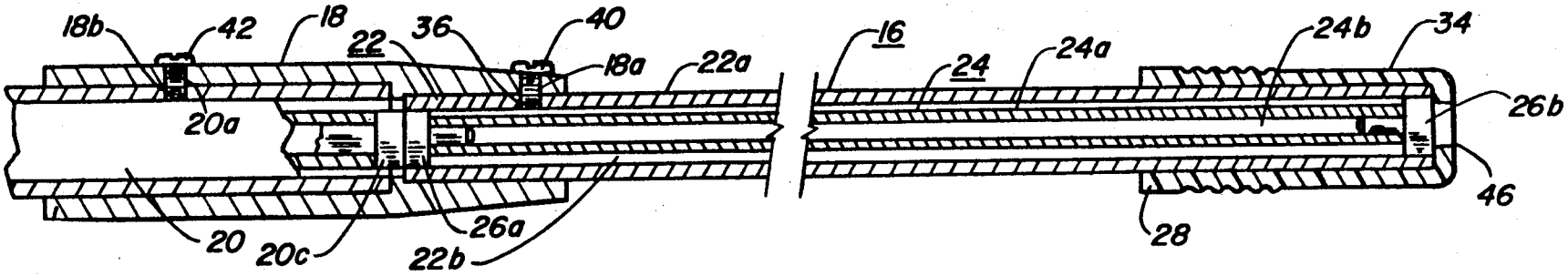
FIG. 2 is a sectional view taken through 2—2 of FIG. 1 to illustrate the assemblage of the components of the invention, the attaching of the assemblage to an adapter and the attaching of the adapter to a tiller control handle.

The present invention components as shown in FIG. 2 consists, of a tiller handle extension member 22 having a body 22*a* and a longitudinal bore 22*b* through body 22*a*, an actuator 24 having a body 24*a* and a longitudinal bore 24*b* through body 24*a*, with the body 24*a* having a smaller diameter and length than the body 22*a* of the tiller handle extension member 22. Buttons 26*a* and 26*b* are internally mounted into bore 24*b* of the actuator 24. A retainer 28 is positioned on the body 22*a*, at one end, of the tiller handle extension member 22 for retaining the actuator 24 within the bore 22*a* of the tiller handle extension member 22. Also shown in FIG. 2 is an adapter 18, not claimed, in which the present invention tiller extension handle 16 is inserted therein and secured thereto.

To insure there is a complete understanding of the components of the present invention FIGS. 3 thru 7 are provided for clarification.

Figure 3:
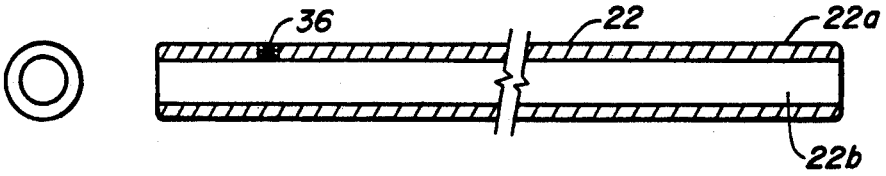
FIG. 3 is a sectional view of the tiller handle extension member.

The tiller handle extension member 22, as shown in FIG. 3, may be constructed of any geometric shape, including but not limited to circular and or rectangular shapes, and is usually about two (2) feet in length. The preferred shape of the tiller handle extension member is circular in cross section. The length of the tiller handle extension member 22 may vary depending on the length an operator may be comfortable with, thus, it should not be limited in length. The tiller handle extension member 22, usually has a bore 22*b* diameter of about ⅞ths of an inch, a body 22*a* diameter of about 1 inch and a length of about two feet. It is not the intention of this specification to limit the tiller handle extension member 22 or any other member of the present invention to specified diameters or length, because a variety of diameters and lengths may be used depending on the requirements of an operator and the type of adapter that is to be used. The tiller handle extension member 22 may be made from any material having longitudinal strength, such as metals or plastics. Although the tiller handle extension member 22 may be made from any material, the preferred material is aluminum. Plastic material may also be used because of its versatility and low cost, but only if it has the required strength to perform the tasks necessary to control the tiller control handle. The tiller handle extension member 22, as shown in FIG. 3, is provided with a tapped or drilled hole 36. The type of hole depends on whether a self tapping screw or a threaded screw is to be used. The hole 36 mates with a drilled or tapped hole 18*a* in an adapter 18 so as to secure them together by a screw 40. The adapter 18, as shown in FIG. 2, has two (2) drilled or tapped holes 18*a* and 18*b*. Again, the type of hole depends on whether a self tapping or threaded screw is being used. It should be noted that no matter what adapter is used in combination with the present invention, it will have the same aforementioned holes located in a similar, if not the same position, as shown in FIG. 2. One hole, 18*b*, mates with a drilled or tapped hole 20*a* in the tiller control handle 20 for insertion of a screw 42 so as to centrally attach the adapter 18 to the tiller control handle 20. The other hole 18*a*, as mentioned above, is to mate with the drilled or tapped hole 36 in the body 22*a* of the tiller handle extension member 22 to secure the tiller handle extension 16 to the adapter 18 by using screw 42. A variation of the tiller handler extension member 22 is to roll the outer surface of one end of the extension member body 22*a* inwardly so as to provide an indented lip 48, which will protrude into the bore 22*b* of the extension member 22, as shown in FIG. 7. This indented lip may then be used as a stop to retain the actuator 24 within the extension member 22. This would be used in place of the retainer 34, shown in FIG. 6, which will be discussed in a later paragraph.

Figure 5:
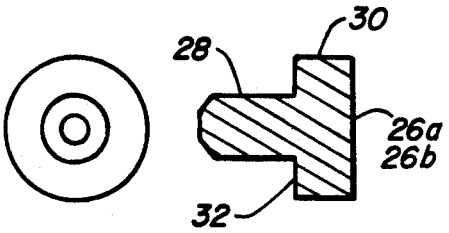
FIG. 5 is a sectional view of a button used in the actuator.
Figure 4:
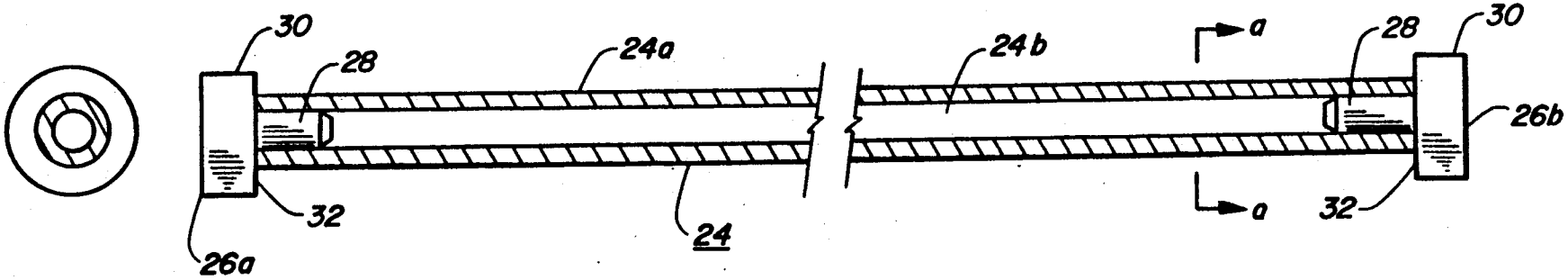
FIG. 4 is a sectional view of the actuator having buttons inserted within its bore at each end.

The actuator 24, shown in FIG. 4, may also be made from any geometric shape such as, but not limited to circular and or rectangular shapes. The preferred shape of the actuator is circular in cross section. The actuator 24 has a body 24*a* and a longitudinal bore 24*b* through the body. The actuator 24 is of such a length that when the buttons 26*a* and 26*b* are inserted into the bore 24*b* of the actuator 24, there is a slight difference between the length of the tiller handle extension member 22 and the assembled actuator with the buttons therein. The actuators 24 body 24*a* is usually about one foot eleven and 3/16th of an inch in length with an outside diameter of about ½ inch. The actuator bore 24*b* is about ⅜ths of an inch in diameter. The buttons are each about ¾ths of an inch in length. The actuator 24 with the buttons 26*a* and 26*b* installed is usually about one foot eleven and 15/16th of an inch in length. This is about 1/16 of an inch shorter in length than the tiller handle extension member 22. The aforementioned lengths may vary according to the adapter being used and the preference of an operator. In any case, the button 26*a* must be in close proximity to the kill button 20*c*, as shown in FIG. 2, on a tiller control handle. This difference is important and will be discussed in a later paragraph. The material used to construct the actuator 24 has to have sufficient strength so as to not bend when a compressive force is applied such as any metal. However, the preferred material of the actuator 24 is plastic because of its low cost. As shown in FIG. 5, the buttons 26*a* and 26*b* consist of two diameters, a first diameter 28 having a diameter of about ⅜ths of an inch and a length of about ⅜ths of an inch and a second diameter 30 having a diameter about ⅞ths of an inch and a length also about ⅜ths of an inch, for a total overall length of ¾ths of an inch. The first diameter 28 of the buttons 26*a* and 26*b* is installed within the bore 24*b* of the actuator 24. The second diameter 30, when the first diameter is seated acts as a shoulder 32, as shown in FIG. 4, so when the buttons 26*a* and 26*b* are placed into the actuator 24, their shoulders 32 will seat against the end of the actuator 24. The second diameter 30 is sized so when the buttons 26*a* and 26*b* are positioned in the actuator 24 there will be provided a sliding fit between the second diameter 30 of the buttons 26*a* and 26*b* and the bore 22*b* of the tiller handle extension member 22. As shown in FIG. 4, the buttons 26*a* and 26*b* are inserted into the bore 24*b* of the actuator 24, with the first diameter 28 contacting the inside of the bore 24*b* of the actuator 24, while the second diameter 30 or shoulders 32 of the buttons 26*a* and 26*b* are seated at each end of the actuator 24. The buttons 26*a* and 26*b* may be made from several different types of materials, such as plastic, metal or elastomeric material. The preferred material for the purposes of this invention is an elastomeric material.

Figure 6:
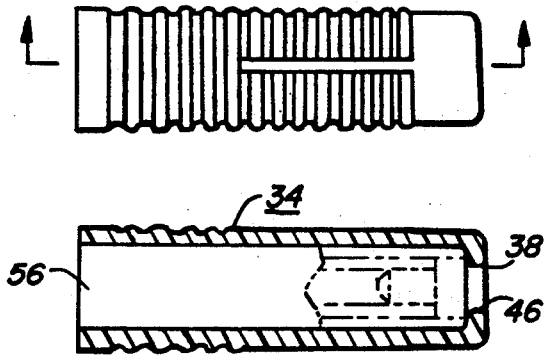
FIG. 6 is a sectional view of the retainer used to contain said actuator within said tiller handle extension member.
Figure 7:
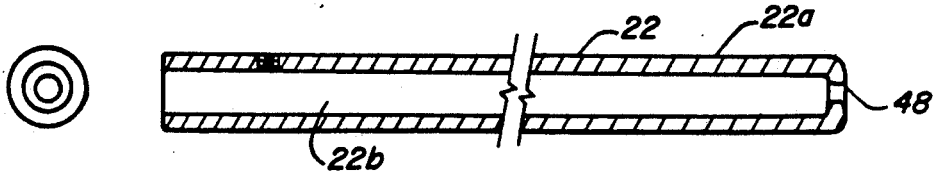
FIG. 7 is a sectional view of a variation of the tiller handle extension member illustrating the indented lip.

As depicted in FIG. 6, a retainer 34 is shown that retains the actuator 24 within the body 22*a* of the tiller handle extension member 22, as shown in FIG. 2. The retainer 34 is a grip made similar to one used as a bicycle grip for use on the handle bars of a bicycle. The grip has a first inside diameter 56 at least of about one (1) inch and a second inside diameter 38 of at least of about 13/16th of an inch. The first inside diameter 56 is the same as or of a slightly larger diameter than the outside diameter of the body 22*a* of the tiller handle extension member 22. This is to facilitate the slipping of the grip over the outside diameter of the body 22*a* with the grip being positioned only at one end. The grip is then slipped over one end of the body 22*a*, as shown in FIG. 2, and pushed down onto an end of the body 22*a* of the tiller handle extension member 22. The second inside diameter 38 of the grip is also smaller than the outside diameter of the tiller handle extension body 22*a* and smaller than the second diameter 30 of the button 26. Due to this relationship, the second inside diameter 38 of the grip forms an indented peripheral edge 46 on the inside of the grip . This indented edge 46 provides a stop at one end of the inside of the bore 22*b* of the tiller handle extension member 22. As shown in FIG. 2 the indented edge 46 is sufficient to retain the buttons 26 within the bore 22*b* of the tiller handle extension member 22, and in turn retains the actuator 24. The retainer 34 is sized according to the size of the tiller handle body 22*a* diameter and may vary according to the need of an operator. The retainer 34 may be made of different types of material, such as plastic or different metals, but the preferred material is rubber or some other slip resistant material.

FIG. 2 illustrates how the components of the present invention are assembled.

The first step is to slip the retainer 34 or grip over the diameter of body 22*a*, at one end of the tiller handle extension member 22. It is important that the grip be seated up against the end of the tiller handle extension body 22*a*, as shown in FIG. 2, so the indented peripheral edge 46 is snug against one end of the extension member body 22*a*. This may be insured by wetting-/soaping the inside of the grip so it will slide easily over the surface of the body 22*a* of the tiller handle extension member 22 more easily and seat itself accordingly. Next is the inserting of the buttons 26*a* and 26*b* into each end of the actuator 24, as shown in FIG. 4. The buttons are seated as mentioned in an earlier paragraph and as shown in FIG. 4. The assembled actuator is then slidably mounted within the bore 22*b* of the tiller handle extension member 22 until the button 26*b* on the inserted end comes into contact with the indented edge 46 of the retainer 34. The end of the assembled tiller handle extension 16 opposite the retainer 34 is then inserted into an adapter 18 to a pre-selected depth, usually about two (2) inches. This depth may vary according to the adapter being used. The present invention tiller handle extension 16 is then secured to an adapter 18 by placing a screw 40 through a drilled or tapped hole 18*a* provided in the adapter 18, lining the screw up with the provided drilled or tapped hole 36 in the body 22*a* of the tiller handle extension member 22 and then securing them together. The adapter 18, after being secured to the tiller handle extension 16, is then slidably mounted onto the tiller control handle 20, after the tiller control handle is made ready to receive same. The adapter 18 is then secured to the tiller control handle 20 by placing a screw 42 through a second drilled or tapped hole 18*b* in the adapter 18 which mates with a provided drilled or tapped hole 20*a* in the tiller control handle 20 and then screwing them together. As mentioned in an earlier paragraph the tiller handle extension 16 is seated at a pre-selected depth within the adapter 18. Because the tiller handle extension 16 is seated at a preselected depth, the button 26*a* in the actuator 24 in the tiller handle extension member 22 is positioned in close proximity to the kill button 20*c* of the tiller control handle 20, as shown in FIG. 2, so as to be almost touching the kill button 20*c*. Therefore, when an operator pushes the opposite button 26*b* at the other end of the tiller handle extension 16, the original kill button 20*c* which is in the tiller control handle 20 is depressed and stops the motor. Furthermore, due to the way the adapter is attached to the tiller control handle there is no interference with the kill switch not shown in FIG. 2, but which is usually located closer to the motor. Because there is no interference with the safety feature associated with the kill switch, operators may continue to operate their boats safely.

In addition to the ability of the present invention to stop the motor, the present invention also permits the operator to continue to have control over the throttle. This is due to the fact that the tiller handle extension handle is in fact an extension of the tiller control handle, therefore, whatever movement is made with the tiller handle extension the same is made to the tiller handle.

As one might see the present invention has distinct advantages over the prior art. One such advantage being the ability of the operator to stop the motor when in a forward position in the boat without sacrificing his safety. Another advantage is that an operator does not have to disassemble the extension handle to push the kill button. And still another advantage is that the operator doesn't sacrifice the use of the kill switch and lanyard.

The scope of the present invention is not to be limited by the above description but is only limited by the following claims.

What is claimed is:

1. A tiller handle extension for controlling a marine type outboard motor having a tiller control handle with an adapter, said adapter being slidably mounted onto said tiller control handle, and secured thereto, said adapter and said tiller control handle having the same center line, comprising:

a tiller handle extension member having a body for positioning within said adapter in a central position relative to the center line of said adapter, and a longitudinal bore throughout said body;

an actuator having a body, a longitudinal bore throughout said body and buttons internally mounted in each end of said bore to permit said actuator to be slidably mounted and centralized within said bore of said tiller handle extension member; and a retainer positioned at one end of said body of said tiller handle extension member for retaining said actuator within said bore of said tiller handle extension member.

* * * * *